US011020795B2

(12) United States Patent
Von Eynatten et al.

(10) Patent No.: US 11,020,795 B2
(45) Date of Patent: Jun. 1, 2021

(54) METHOD AND DEVICE FOR PRODUCING FOUNDRY INGOTS FROM METAL

(71) Applicant: Inteco Melting and Casting Technologies GmbH, Mur (AT)

(72) Inventors: Klaus Von Eynatten, Leoben (AT); Harald Holzgruber, Mur (AT); Heinz Rumpler, Leoben (AT)

(73) Assignee: Inteco Melting and Casting Technologies GmbH, Mur (AT)

( * ) Notice: Subject to any disclaimer, the term of this patent is extended or adjusted under 35 U.S.C. 154(b) by 0 days.

(21) Appl. No.: 16/605,035

(22) PCT Filed: Apr. 17, 2018

(86) PCT No.: PCT/EP2018/059728
§ 371 (c)(1),
(2) Date: Oct. 14, 2019

(87) PCT Pub. No.: WO2018/192903
PCT Pub. Date: Oct. 25, 2018

(65) Prior Publication Data

US 2021/0023611 A1 Jan. 28, 2021

(30) Foreign Application Priority Data

Apr. 20, 2017 (DE) ..... 10 2017 108 394.4

(51) Int. Cl.
*B22D 11/04* (2006.01)
*B22D 11/041* (2006.01)
(Continued)

(52) U.S. Cl.
CPC ..... *B22D 11/1281* (2013.01); *B22D 11/0401* (2013.01); *B22D 11/041* (2013.01);
(Continued)

(58) Field of Classification Search
CPC ..... B22D 11/081; B22D 11/083
See application file for complete search history.

(56) References Cited

U.S. PATENT DOCUMENTS 3,844,333 A * 10/1974 Peytavin ..... B22D 11/083 164/483
4,612,972 A * 9/1986 Dantzig ..... B22D 27/02 164/122
4,989,666 A * 2/1991 Weber ..... B22D 11/015 164/467

FOREIGN PATENT DOCUMENTS

CN 2043531 U 8/1989
CN 106029254 A 10/2016
(Continued)

OTHER PUBLICATIONS

Gueussier et al., "Specific aspects of rotary continuous casting", Iron and Steel Engineering, vol. 59, No. , Jan. 1, 1982, pp. 53-59.
(Continued)

*Primary Examiner* — Kevin E Yoon
(74) *Attorney, Agent, or Firm* — Bachman & LaPointe, PC

(57) ABSTRACT

The invention relates to a method for producing foundry ingots (1) from metal, in particular from steel, having a cross-sectional area of more than 0.1 $m^2$, wherein liquid metal (2) is discharged into an ingot mold (15) open at the bottom either directly form a casting ladle (11) or via a tundish (12), and wherein, by a drawing piston (28), which is vertically movable in the direction of a longitudinal axis (5) of the foundry ingot (1) and on which the foundry ingot (1) is at least indirectly arranged, the at least partially solidified foundry ingot (1) is drawn from the ingot mold (15) in the direction of the longitudinal axis (5).

8 Claims, 1 Drawing Sheet

(51) Int. Cl.

| | |
|---|---|
| ***B22D 11/08*** | (2006.01) |
| ***B22D 11/128*** | (2006.01) |
| ***B22D 11/115*** | (2006.01) |
| ***B22D 11/12*** | (2006.01) |
| ***B22D 11/124*** | (2006.01) |

(52) U.S. Cl.
CPC ..... *B22D 11/0405* (2013.01); *B22D 11/081* (2013.01); *B22D 11/083* (2013.01); *B22D 11/115* (2013.01); *B22D 11/122* (2013.01); *B22D 11/124* (2013.01)

(56) References Cited

FOREIGN PATENT DOCUMENTS

| | | | |
|---|---|---|---|
| JP | 09276993 | A | 10/1997 |
| KR | 20100085748 | A | 7/2010 |
| WO | 8701632 | A1 | 3/1987 |
| WO | 2015079071 | A2 | 6/2015 |
| WO | 2015101553 | A2 | 7/2015 |

OTHER PUBLICATIONS

International search report for patent application No. PCT/EP2018/059728 dated Jun. 22, 2018.

* cited by examiner

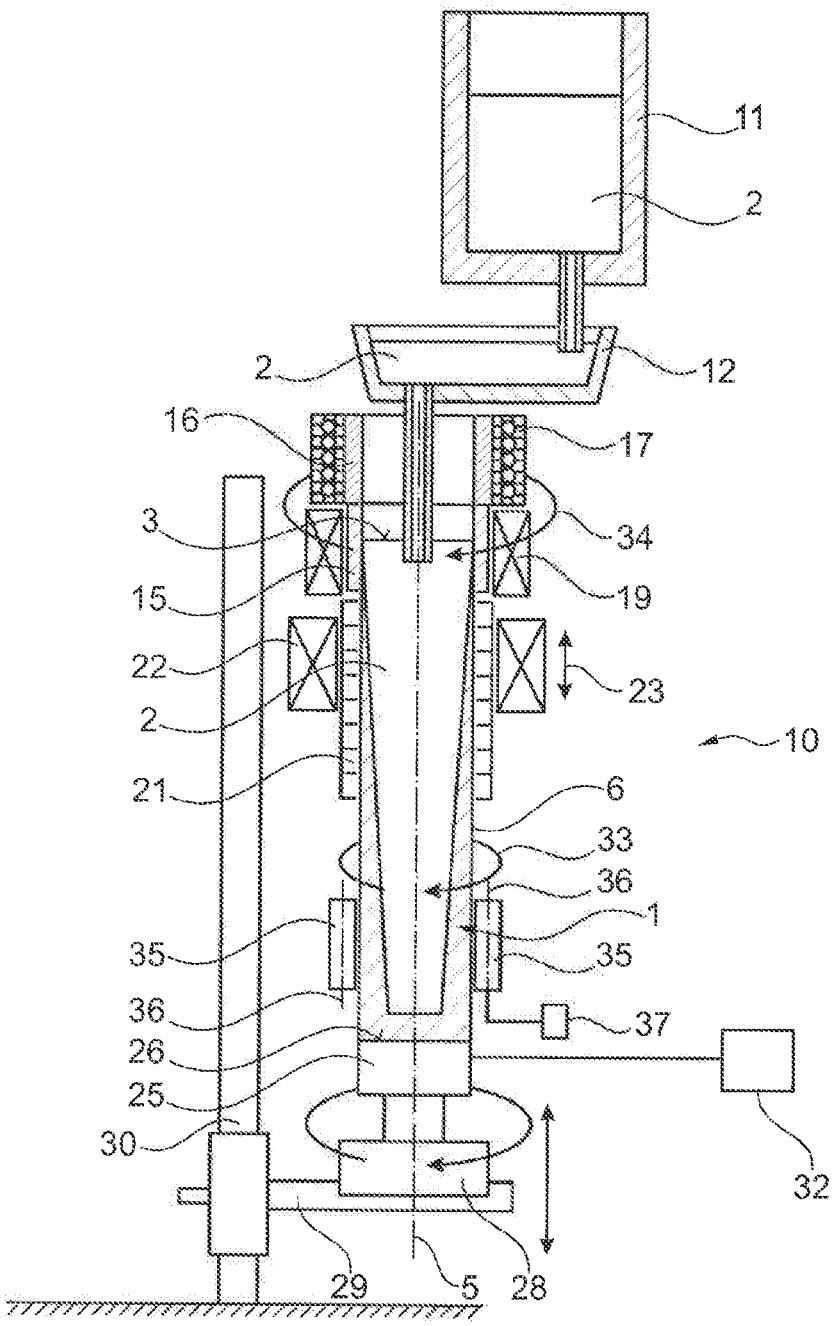
11
2
2
12
16
17
3
34
15
19
22
23
2
10
21
6
33
36
1
35
35
36
37
26
25
30
32
29
5
28

METHOD AND DEVICE FOR PRODUCING FOUNDRY INGOTS FROM METAL

STATE OF THE ART

The invention relates to a method for producing ingots from metal, in particular from steel, having a cross-sectional area of more than 0.1 $m^2$ according to the preamble of claim 1. Furthermore, the invention relates to a device for performing the method according to the invention.

From WO 2015/079071 A2, a generic method is known, which is characterized in that the cast ingot is rotated about its longitudinal axis in the area of a tertiary cooling section only after complete withdrawal from an ingot mold, i.e. after completion of the casting process.

From the applicant's WO 2015/101553 A2, another method for producing ingots from metal having the features of the preamble of claim 1 is known. Small quantities of ingots having a diameter of 300 mm and more and block lengths of more than 5 m can be efficiently produced by means of the known method, liquid metal continuing to be fed to the ingot mold circulation after the end of the regular casting process in such an amount that at least the shrinkage of the metal or steel melt occurring during the solidification is compensated.

Additionally, there is a call for a high-quality ingot regardless of the diameter or the length of the ingot. This relates in particular to a good solidification structure, in particular with respect to the segregation and the porosity of the center, so that such ingots can make full use of their (quality) properties. The method known from the aforementioned disclosure does not indicate any measures to ensure or to obtain an optimal casting quality because the disclosure deals primarily with maximum efficiency.

DISCLOSURE OF THE INVENTION

Starting from the aforementioned state of the art, the object of the invention is to improve a method for producing ingots from metal, in particular from steel, having a cross-sectional area of more than 0.1 $m^2$ according to the preamble of claim 1 in such a manner that the produced ingots have a particularly high quality. This means, in particular, that the cross section of such an ingot can be realized so as to be as homogenous and as free of segregation as possible and comprising pores and cavities which are as few or small as possible.

Concerning a method for producing ingots from metal, said object is attained by the features of claim 1 by at least temporarily rotating the ingot about its longitudinal axis, at least during the casting process, the rotation of the ingot being preferably realized via a pedestal element or a withdrawing tool on which the ingot stands with its facing side.

Such an at least temporary rotation of the ingot about its longitudinal axis during the casting process while the liquid metal of the ingot has not completely solidified yet acts like an electromagnetic stirrer over the entire ingot length, the solidified ingot thus having a greatly reduced porosity and segregation of the center. Furthermore, it has been found that the solidification time can be reduced by the constant movement of the still liquid metal melt in the ingot and, therefore, a particularly high performance per time unit in the generation or production of ingots can be achieved.

Advantageous embodiments of the method according to the invention for producing ingots from metal are disclosed in the dependent claims. All combinations of at least two features disclosed in the description, the claims and/or the FIGURES constitute part of the scope of the invention.

As explained above, the principle of the invention consists in an at least temporary rotation of the ingot about its longitudinal axis while the metal of the ingot is not completely solidified yet, the rotation already taking place during the actual casting process, i.e. within the area of the ingot mold. The time for the start and the end of the rotation of the ingot, the type of rotation and the direction of rotation depend on different factors and are to be adjusted to the specific application, if required. A first version of the method, which is particularly simple to realize in terms of the device, provides that the ingot is continuously rotated in a (single) direction about the longitudinal axis.

Alternatively, the ingot may be rotated in an oscillating manner about the longitudinal axis, for example, about a rotation angle of ±45° with respect to a mean position.

An additional possibility for influencing the quality or the solidification properties of the ingot provides that the rotational angular velocity of the ingot about the longitudinal axis is varied during the rotation of the ingot. For example, a constant increase or reduction of the rotational angular velocity or a sudden stopping and a subsequent rotating with high acceleration can be provided.

During the production of the ingot, liquid metal constantly enters the area of the ingot mold, the at least partially solidified block being withdrawn by means of the withdrawing tool at the same time, so that liquid metal can continue to be supplied. In general, such a withdrawing movement of the ingot takes place continuously, i.e. at a constant withdrawing speed, at least until the time of the end of the casting, at which point the withdrawing speed is reduced, for example.

An additional version of the above-described method according to the invention provides that the ingot mold (in addition to the ingot) is rotated about the longitudinal axis. Such a rotation of the ingot mold about the longitudinal axis can be realized either by means of an additional, separate drive or by the fact that the ingot mold is disposed so as to be rotatable about its longitudinal axis and that a rotation of the ingot mold is caused by the friction with the metal of the ingot.

Furthermore, the ingot may continue to be rotated about its longitudinal axis for a certain duration of time after the end of casting in order to obtain the highest quality possible. The rotation of the ingot about its longitudinal axis is to be performed, in particular, until it is ensured that the cross section of the ingot has completely solidified over its entire length.

An additional optimization of the quality of the ingot can be obtained if the liquid metal of the ingot is moved by means of an electromagnetic stirring coil. Such a stirring coil can be disposed so as to either be fixed in the area of the ingot or to be longitudinally displaceable in the direction of the longitudinal axis of the ingot about the ingot. It is also possible to provide a combination of a fixed and a displaceable electromagnetic stirring coil.

Furthermore, the invention comprises a device for performing the above-described method according to the invention, the device having a casting ladle and a tundish, if required, for introducing liquid metal melt into an ingot mold open at the bottom. Additionally, a withdrawing tool which is vertically moveable is provided for at least indirectly disposing the ingot on a pedestal surface facing the ingot mold. The device according to the invention is characterized by means for rotating the ingot about its longitudinal axis.

According to a version for rotating the ingot about the longitudinal axis which can easily be realized in terms of the equipment needed, the means are formed by the withdrawing tool itself or by a pedestal element on which the ingot stands, the withdrawing tool or the pedestal element being rotatable about its longitudinal axis by means of a drive. With means for string rotation of such a design, mechanical loads of the circumferential surface of the ingot are avoided, in particular.

Alternatively or additionally, the means may be formed by driving means, in particular in the form of rotatable rolls or rollers, acting on the outer circumference of the ingot. Such rolls or rollers are in contact, at least frictionally, with the outer circumference of the ingot and cause the desired rotation of the ingot, in which case the withdrawing tool needs to be disposed so as to also be rotatable (merely) about the longitudinal axis but does not need a separate drive.

Furthermore, the ingot mold may be disposed so as to be rotatable about the longitudinal axis and/or at least one electromagnetic stirring coil may be provided for the ingot.

Further advantages, features and details of the invention can be derived from the following description of preferred exemplary embodiments and from the drawing.

In the only FIGURE, it shows a highly simplified longitudinal section of a device for producing an ingot.

Device 10 shown in the FIGURE is used for the discontinuous production of an ingot 1 from metal 2, in particular from steel, having a cross-sectional area of preferably more than 0.1 $m^2$ and a length of, for example, up to 15 m. The cross-sectional area of ingot 1 is preferably circular, but it can also be in the form of a rectangle or a square or in any other desired form.

Device 10 comprises a casting ladle 11 from which liquid metal 2, via a provided tundish 12, if required, can be withdrawn into an ingot mold 15 open at the bottom. Above ingot mold 15, a lining 16 which is radially surrounded by a heating device in the form of an induction coil 17 can optionally be provided at the side which faces tundish 12. The unit of lining 16 and heating device or induction coil 17 is also known as a "feeder". The feeder is used for the heating of the liquid metal, in particular at the end of casting.

It is additionally mentioned that another form and disposition of a heating device can be provided, for example, in the form of heating rods, electrodes etc. disposed above lining 16.

At the side facing away from tundish 12, ingot mold 15, which can optionally be radially surrounded by an electromagnetic stirrer 19, is adjacent to ingot 15. Meniscus 3 of the metal melt is exemplary located in the area of ingot mold 15; meniscus 3 may be covered by a powder (not shown) for lubrication and/or for (thermal) insulation. Furthermore, it is to be mentioned that the inner cross section of ingot mold 15 is adjusted or equivalent to the cross section of ingot 1 to be formed.

If required, a cooling device 21 which is disposed in operative connection with ingot 1 is located underneath ingot 15 at the side facing away from tundish 12. An additional electromagnetic stirrer 22 which can be disposed so as to be movable along longitudinal axis 5 of ingot 1 in the direction of double arrow 23 can optionally be provided underneath ingot mold 15.

Furthermore, it is mentioned that ingot mold 15 may be disposed so as to be rotatable about longitudinal axis 5 of ingot 1 and ingot mold 15 by means of bearing devices (not shown).

Underneath ingot 1, a pedestal element 25 which is cooled, if applicable, and which forms a pedestal surface 26 for ingot 1 at the side facing ingot 1 is provided. Pedestal element 25 is connected to a withdrawing tool 28 which is connected to a longitudinal column 30 via a cross member 29. Cross member 29 or withdrawing tool 28 can be raised and lowered in the direction of longitudinal axis 5 by means of a drive (not shown). Furthermore, pedestal element 25 may also be mounted so as to be rotatable about longitudinal axis 5 and an active rotation of ingot 1 about longitudinal axis 5 during the casting process of ingot 1 can be generated by means of a drive 32.

It is exemplarily shown that pedestal element 25 and ingot 1 and ingot mold 15 rotate clockwise according to arrows 33, 34. Preferably, drive 32 is configured in such a manner that, depending on the specific application, it can move ingot 1 or pedestal element 25 also in an oscillating manner, for example, by 45° about a mean position of ingot 1, as well as at different rotational angular velocities according to a provided velocity profile.

If no pedestal element 25 rotatable about longitudinal axis 5 by means of a drive 32 is provided, rolls 35 which can rotate about an axis 36 and which are driven by means of a drive 37 and which act on circumference 6 of ingot 1 above pedestal element 25 can serve as an alternative, for example. In general, several of these rolls 35 are provided, preferably in equal angular distances about longitudinal axis 5.

During the production of ingot 1, ingot 1 is withdrawn from ingot mold 15 downward in the direction of longitudinal axis 5 by means of withdrawing tool 28. The withdrawing speed of ingot 1 can be constant or discontinuous. Furthermore, an at least temporary rotation of ingot 1 about longitudinal axis 5 takes place during the withdrawal of ingot 1 from ingot mold 15, i.e. during the casting process and after the end of the withdrawing process, if required.

Liquid metal 2 solidifies inside ingot 1 from outer circumference 6 of ingot 1 to longitudinal axis 5. After the regular end of the casting process, liquid metal may continue to be fed into ingot mold 15 according to the disclosure of WO 2015101553 A2 in order to made up for the shrinkage of the metal melt.

Above-described device 10 and the described method can be altered or modified in many ways without deviating from the idea of the invention.

REFERENCE SIGNS

1 ingot
2 metal
3 meniscus
5 longitudinal axis
6 outer circumference
10 device
11 casting ladle
12 tundish
15 ingot mold
16 lining
17 induction coil
19 stirrer
21 cooling device
22 electromagnetic stirrer
23 double arrow
25 pedestal element
26 pedestal surface
28 withdrawing tool
29 cross member
30 longitudinal column
32 drive
33 arrow

34 arrow
35 roll
36 axis
37 drive

The invention claimed is:

1. A method for producing ingots (1) from metal having a cross-sectional area of more than 0.1 $m^2$, liquid metal (2) being discharged either directly from a casting ladle (11) or via a tundish (12) into an ingot mold (15) open at the bottom, the at least partially solidified ingot (1) being withdrawn from the ingot mold (15) in the direction of a longitudinal axis (5) of the ingot (1) using a withdrawing tool (28) which is vertically movable in the direction of the longitudinal axis (5) and on which the ingot (1) is at least indirectly disposed, and the ingot (1) being at least temporarily rotated about its longitudinal axis (5), at least during the casting process, wherein the rotation of the ingot (1) is realized via a pedestal element (25) or a withdrawing tool (28) on which the ingot (1) stands with its facing side wherein the ingot (1) is rotated in an oscillating manner about the longitudinal axis (5).

2. The method according to claim 1, wherein the ingot (1) is continuously rotated in a direction about the longitudinal axis (5).

3. The method according to claim 2, wherein the rotational angular velocity of the ingot (1) about the longitudinal axis (5) is varied during the rotation of the ingot (1).

4. The method according to claim 1, wherein the ingot (1) is discontinuously moved during the withdrawal from the ingot mold (15) in the direction of the longitudinal axis (5).

5. The method according to claim 1, wherein the ingot mold (15) is rotated about the longitudinal axis (5).

6. The method according to claim 1, wherein the rotation of the ingot (1) is continued for a specific time period after the end of the casting process.

7. The method according to claim 1, wherein the liquid metal (2) of the ingot (1) is moved using at least one electromagnetic stirring coil (19, 22).

8. The method of claim 1, wherein the metal is steel.

* * * * *